US011668096B2

(12) United States Patent
Li

(10) Patent No.: US 11,668,096 B2
(45) Date of Patent: Jun. 6, 2023

(54) ROPE CONNECTOR, ROPE ASSEMBLY AND RAILING

(71) Applicants: MultiRail Stainless Inc., Winnipeg (CA); Jialin Li, Winnipeg (CA)

(72) Inventor: Jialin Li, Winnipeg (CA)

(73) Assignees: MULTIRAIL STAINLESS INC., Manitoba (CA); Jialin Li, Manitoba (CA)

( * ) Notice: Subject to any disclaimer, the term of this patent is extended or adjusted under 35 U.S.C. 154(b) by 154 days.

(21) Appl. No.: 16/882,941

(22) Filed: May 26, 2020

(65) Prior Publication Data

US 2021/0372131 A1 Dec. 2, 2021

(51) Int. Cl.
*E04F 11/18* (2006.01)

(52) U.S. Cl.
CPC ..... *E04F 11/1817* (2013.01); *E04F 11/1859* (2013.01); *E04F 2011/1819* (2013.01); *E04F 2011/1885* (2013.01)

(58) Field of Classification Search
CPC ..... E04F 11/1817; E04F 11/1859; E04F 2011/1819; E04F 2011/1885; E04H 17/10; E04H 17/124; E04H 17/127; E04H 17/131; Y10T 24/3969; Y10T 24/3996; F16G 11/04; F16G 11/048
USPC ..... 256/39, 41, 44, 47
See application file for complete search history.

(56) References Cited

U.S. PATENT DOCUMENTS 570,090 A * 10/1896 Haley ..... E04H 17/266 256/DIG. 1
2,128,030 A * 8/1938 Koleno ..... E04H 17/04 267/72
3,085,306 A * 4/1963 Drysdale ..... F16G 11/048 403/44
4,899,499 A * 2/1990 Hoekstra ..... E01F 13/028 52/146
6,414,242 B2 * 7/2002 Schmidt ..... G01F 23/268 73/866.5
8,051,615 B2 * 11/2011 Mathews ..... F16G 11/106 52/223.13
RE43,194 E * 2/2012 Toimil ..... F16G 11/106 24/136 R (Continued)

FOREIGN PATENT DOCUMENTS

CN 105544901 A * 5/2016 ..... E04F 11/1859
DE 9420017 U1 * 5/1995 ..... F16G 11/048

(Continued)

*Primary Examiner* — Michael P Ferguson
*Assistant Examiner* — Zachary A Hall
(74) *Attorney, Agent, or Firm* — WPAT, P.C

(57) ABSTRACT

A rope connector includes a connecting part, a sleeve, a movable rod, an elastic member, and a clamping member. An end of the sleeve connects an end of the connecting part, and the other end is disposed with an opening communicating with an interior of the sleeve. An end of the movable rod is movably placed inside the sleeve after passing through the opening, and the other end connects the clamping member. The elastic member is placed inside the sleeve, an end abuts against an edge of the opening, and the other end connects one end of the movable rod. An end of the clamping member away from the movable rod is suitable for detachably connecting with a rope. The rope connector is convenient for rope connection and automatic adjustment of tension.

12 Claims, 3 Drawing Sheets

(56) References Cited

U.S. PATENT DOCUMENTS 9,181,967 B2 * 11/2015 Lim ..... F16B 7/18

FOREIGN PATENT DOCUMENTS

KR 101104124 B1 * 1/2012 ..... E01F 7/045
KR 101672788 B1 * 11/2016 ..... E01F 7/04

* cited by examiner

ROPE CONNECTOR, ROPE ASSEMBLY AND RAILING

FIELD OF THE DISCLOSURE

This disclosure relates to the field of connectors technology, and more particularly to a rope connector, a rope assembly and a railing.

BACKGROUND

At present, a steel wire rope tensioning device on the market is used to connect and fix a rope. The rope is hard tensioned, that is, it is fixed at both ends, and the rope is tightened by a thread tightening device. Although such connection method can achieve the purpose of tensioning the rope, service life of the rope will be reduced. The rope will be easy to loosen subjected to an external force during use, which not only affects the appearance, but also may bring safety risks. As a result, it needs to be adjusted frequently to tighten the rope again, which is very inconvenient to use.

SUMMARY

A main objective of the disclosure is to provide a rope connector designed to facilitate rope connection and automatic adjustment of tension, and make installation and usage be more convenient.

To achieve the objective above, the disclosure provides a rope connector. The rope connector includes a first connecting part, a first sleeve, a movable rod, a first elastic member, and a first clamping member. An end of the first sleeve is disposed at an end of the first connecting part, another end of the first sleeve is disposed with a first opening communicating with an interior of the first sleeve; a first end of the movable rod passes through the first opening and is movably disposed inside the first sleeve, and a second end of the movable rod is connected to the first clamping member; the first elastic member is disposed inside the first sleeve, an end of the first elastic member abuts against an edge of the first opening, and another end of the first elastic member is connected to the first end of the movable rod; an end of the first clamping member away from the movable rod is configured for being detachably connected to a rope.

The disclosure further provides a rope assembly. The rope assembly includes a rope, a rope connector or two rope connectors. An end of the rope is connected to the rope connector or two ends of the rope are respectively connected to ends of the two rope connectors, the rope connector(s) is/are the aforementioned rope connector.

The disclosure further provides a rope assembly. The rope assembly includes a rope, a rope connector and a rope connection component. Two ends of the rope are respectively connected to the rope connector and the rope connection component, the rope connector is the aforementioned rope connector, the rope connection component includes a second connecting part, an adjusting rod, and a second clamping member; an end of the second connecting part is disposed with a third connecting portion, another end of the second connecting part is disposed with a fourth connecting portion, and an end of the fourth connecting portion is formed with a holding groove; an first end of the adjusting rod is disposed inside the holding groove, and the adjusting rod is screw-connected to an inner wall of the holding groove; the second clamping member is disposed on another end of the adjusting rod away from the second connecting part.

The disclosure further provides a railing. The railing includes a frame and a rope assembly, the rope assembly is disposed inside the frame, and the rope assembly is the aforementioned rope assembly.

Technical solution of the disclosure includes a first connecting part, a first sleeve, a movable rod, a first elastic member, and a first clamping member, an end of the first sleeve is disposed at an end of the first connecting part, another end of the first sleeve is disposed a first opening communicating with an interior of the first sleeve; a first end of the movable rod passes through the first opening and is movably disposed inside the first sleeve, and a second end of the movable rod is connected to the first clamping member; the first elastic member is disposed inside the first sleeve, an end of the first elastic member abuts against an edge of the first opening, and another end of the first elastic member is connected to the first end of the movable rod; an end of the first clamping member away from the movable rod is configured for being detachably connected to a rope, so that the rope can be installed to the rope connector more conveniently and quickly. Furthermore because of the use of the first elastic member and the movable rod, an opposite elastic force from the first elastic member is applied to the movable rod all the time, so that the rope can always maintain a tension state, which realizes adaptive adjustment of the tension of the rope, and makes use of the rope connector be more convenient.

BRIEF DESCRIPTION OF THE DRAWINGS

In order to more clearly illustrate of embodiments of the disclosure or technical solution(s) in prior art, drawings used in the embodiments will be briefly introduced below. Apparently, the drawings in the description below are merely some embodiments of the disclosure, a person skilled in the art can still obtain other drawings according to these drawings without creative efforts.

LABEL DESCRIPTION IN THE DRAWINGS

| Label | Name |
|---|---|
| 1000 | rope connector |
| 10 | first connecting part |
| 11 | locking portion |
| 12 | first connecting portion |
| 13 | second connecting portion |
| 20 | first sleeve |
| 21 | first opening |
| 22 | second opening |
| 23 | convex portion |
| 30 | movable rod |
| 31 | moving rod |
| 32 | abutting portion |

-continued

| Label | Name |
|---|---|
| 40 | first elastic member |
| 50 | first clamping member |
| 51 | second sleeve |
| 511 | first hole |
| 512 | second hole |
| 52 | first locking member |
| 521 | locking block |
| 522 | second elastic member |
| 523 | first sliding block |
| 53 | first abutting block |
| 54 | second locking member |
| 55 | fourth sleeve |
| 551 | fifth hole |
| 552 | sixth hole |
| 56 | fourth locking member |
| 57 | clamping jaw |
| 571 | holding piece |
| 60 | cushion block |
| 4000 | rope connection component |
| 70 | second connecting part |
| 80 | adjusting rod |
| 90 | second clamping member |
| 91 | third sleeve |
| 911 | third hole |
| 912 | fourth hole |
| 92 | second sliding block |
| 93 | third elastic member |
| 94 | second abutting block |
| 95 | third locking member |
| 100 | third connecting portion |
| 110 | fourth connecting portion |
| 111 | holding groove |
| 2000 | rope assembly |
| 3000 | rope |
| 5000 | frame |

Realization of the objective, characteristics of function and advantages of the disclosure will be further described with reference to the drawings in combination with the embodiment.

DETAILED DESCRIPTION OF EMBODIMENTS

Technical solutions of embodiments of the disclosure will be clearly and fully described in the following with reference to the accompanying drawings in the embodiments of the disclosure. Apparently, the described embodiments are some of the embodiments of the disclosure, but not all of the embodiments of the disclosure. All other embodiments obtained by the skilled person in the art based on the described embodiments of the disclosure without creative efforts are within the scope of protection of the instant application.

Descriptions in the disclosure such as "first", "second" and so on are for descriptive purposes only, and are not to be understood as indicating or implying relative importance or as implying a number of the indicated technical features. Thus, features defined as "first", "second" may explicitly or implicitly include at least one of the features. In addition, the technical solutions in the embodiments may be combined with each other, but it must be based on realization by the skilled person in the art. When combination of technical solutions are contradictory to each other or cannot be realized, the combination should not be considered to exist, and is not within the scope of protection of the disclosure.

Figure 1:
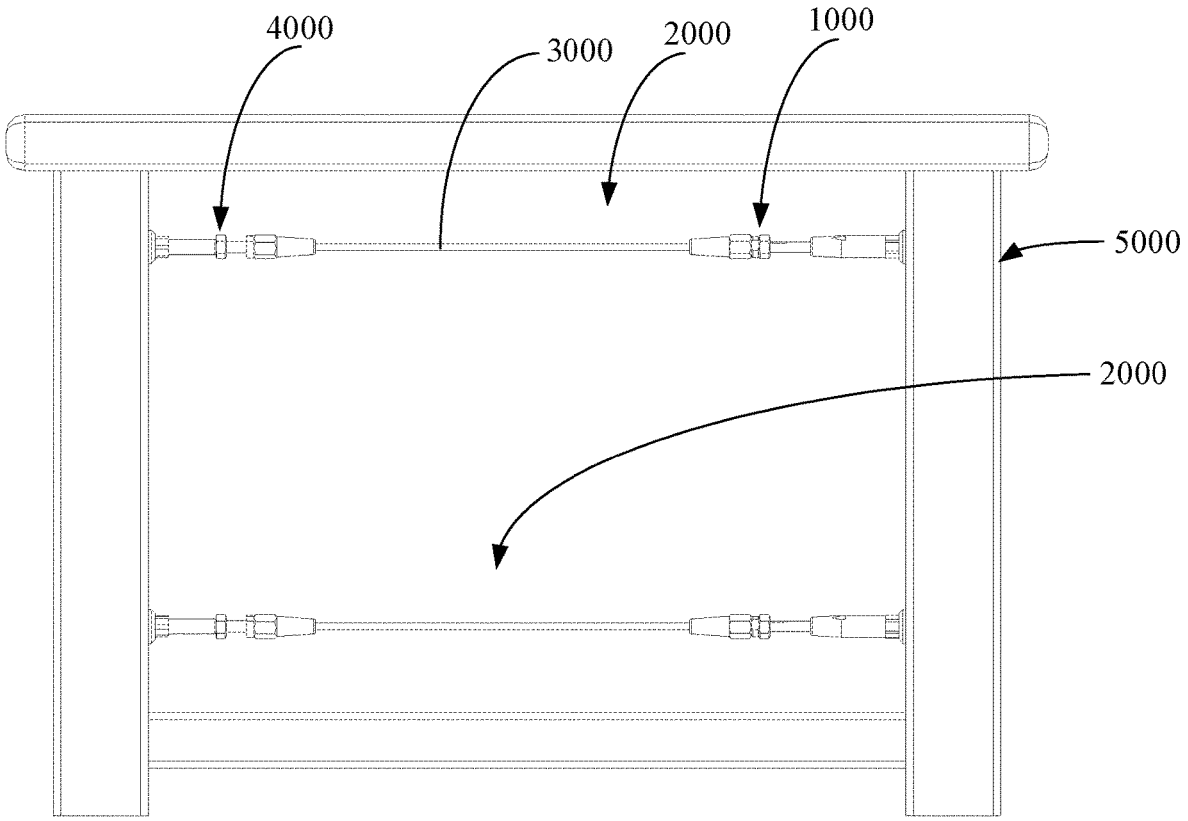
FIG. 1 is a schematic structural view of a railing according to an embodiment of the disclosure.
Figure 2:
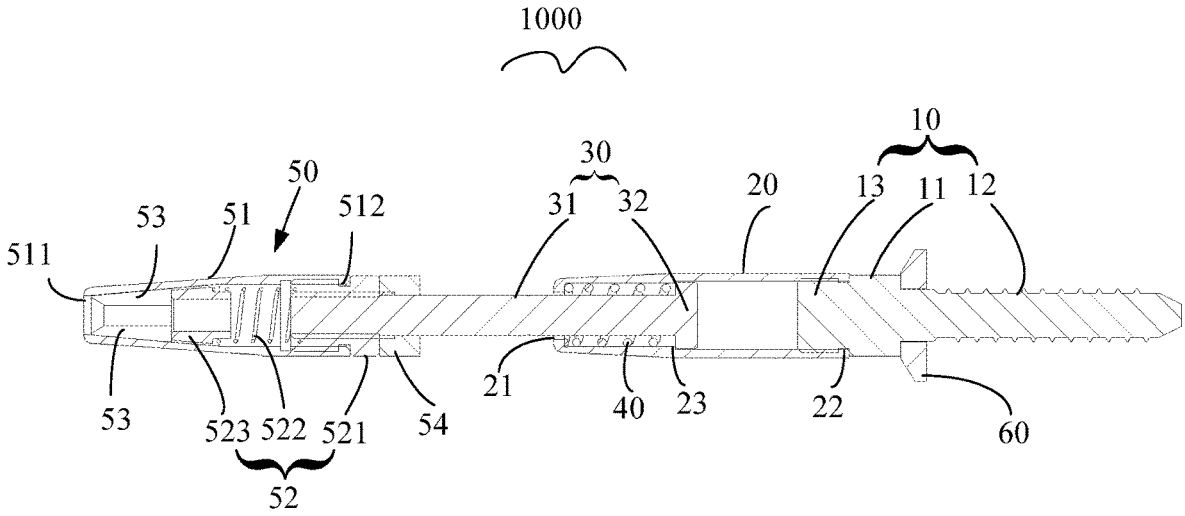
FIG. 2 is a schematic cross-sectional structural view of an embodiment of a rope connector shown in FIG. 1.

Referring to FIGS. 1 and 2, the disclosure provides a rope connector.

In an embodiment of the disclosure, the rope connector 1000 includes a first connecting part 10, a first sleeve 20, a movable rod 30, a first elastic member 40, and a first clamping member 50.

An end of the first sleeve 20 is disposed at an end of the first connecting part 10, another end of the first sleeve 20 is disposed with a first opening 21 communicating with an interior of the first sleeve 20.

A first end of the movable rod 30 passes through the first opening 21 and is movably disposed inside the first sleeve 20, and a second end of the movable rod 30 is connected to the first clamping member 50.

The first elastic member 40 is disposed inside the first sleeve 20, an end of the first elastic member 40 abuts against an edge of the first opening 21, and another end of the first elastic member 40 is connected to the first end of the movable rod 30.

An end of the first clamping member 50 away from the movable rod 30 is suitable for being detachably connected to a rope 3000.

The aforementioned rope connector 1000 can be made of metal or plastic, preferably made of stainless steel. The first elastic member 40 can be a spring. The first clamping member 50 is suitable for realizing quick plugging with the rope 3000 for ease of use. The above technical solutions make the rope 3000 be installed to the rope connector 1000 more conveniently and quickly. Furthermore because of assembly of the first elastic member 40 and the movable rod 30, the first elastic member 40 can apply an elastic force to the movable rod 30 all the time, the elastic force is opposite to direction of the rope 3000, so that the rope 3000 can always maintain a tension state, which realizes adaptive adjustment of the tension of the rope 3000, makes usage of the rope connector 1000 be more convenient, and extends service life of the rope 3000.

In an embodiment of the disclosure, the first sleeve 20 is detachably connected to the first connecting part 10. The first sleeve 20 can be detachably connected to the first connecting part 10 through a thread structure, specifically the first sleeve 20 is provided with an internal thread, and the first connecting part 10 is provided with a suitable external thread, so as to help assembly and disassembly of the rope connector 1000 and make use of the rope connector 1000 be more convenient.

In an embodiment of the disclosure, the first connecting part 10 includes a locking portion 11, a first connecting portion 12 and a second connecting portion 13, the first connecting portion 12 and the second connecting portion 13 are respectively located at two opposite ends of the locking portion 11, the second connecting portion 13 is connected to the second end of the first sleeve 20 away from the first opening 21. The locking portion 11, the first connecting portion 12 and the second connecting portion 13 can be formed integrally. The first connecting portion 12 can be a bolt or a screw stem. The transversal cross-section of the locking portion 11 can be a hexagon structure or a similar structure, which is convenient with an external wrench to clamp on the locking portion 11 and rotate, so as to realize the connection between the first connecting portion 12 and an frame of an external wall or an guardrail, and make the usage of the rope connector 1000 be more convenient.

In an embodiment of the disclosure, the end of the first sleeve 20 away from the first opening 21 is disposed with a second opening 22 communicating with the interior of the first sleeve 20, the second connecting portion 13 passes through the second opening 22 and is disposed inside the first sleeve 20, and the second connecting portion 13 is detachably connected to an inner wall of the first sleeve 20. The second connecting portion 13 can be connected to the inner wall of the first sleeve 20 through a thread structure. The connection between the first sleeve 20 and the second connecting portion 13 can be strengthened by disposing the second connecting portion 13 inside the first sleeve 20, which makes the overall structure be more stable.

In an embodiment of the disclosure, the movable rod 30 includes a moving rod 31 and an abutting portion 32 provided at a first end of the moving rod 31, the abutting portion 32 is disposed inside the first sleeve 20, the first elastic member 40 is sleeved on the moving rod 31, and the another end of the first elastic member 40 away from the first opening 21 abuts against the abutting portion 32. The moving rod 31 and the abutting portion 32 can be integrally formed, and the abutting portion 32 is suitable for facilitating abutment of the first elastic member 40 and assembly of the first elastic member 40.

In an embodiment of the disclosure, a convex portion 23 is disposed on the inner wall of the first sleeve 20. An end of the abutting portion 32 away from the moving rod 31 abuts against the second connecting portion 13 when the movable rod 30 is in a first position, and another end of the abutting portion 32 close to the moving rod 31 abuts against the convex portion 23 when the movable rod 30 is in a second position. The convex portion 23 can be a convex point, a convex block or a ring-shaped step portion. Movement position of the movable rod 30 can be limited by the convex portion 23. Furthermore, overcompression to the first elastic member 40 by the abutting portion 32 can be avoided with the convex portion 23, so as to protect the first elastic member 40, make the movement of the movable rod 30 be more stable, and increase service life of the rope connector 1000.

In an embodiment of the application, the rope connector further includes a ring-shaped cushion block 60. The cushion block 60 is sleeved on the first connecting portion 12. The cushion block 60 can be a plastic spacer or a metal spacer, which is convenient for the first connecting portion 12 to connect to an external wall surface or a guardrail.

In an embodiment of the disclosure, the first connecting member 50 includes a second sleeve 51, a first locking member 52 and at least two first abutting blocks 53.

Two ends of the second sleeve 51 are respectively provided with a first hole 511 and a second hole 512, the first hole 511 and the second hole 512 both communicate with an interior of the second sleeve 51. An inner wall of the second sleeve 51 close to the first hole 511 is of a tapered structure. A transversal cross-section area of the inner wall of the end of the second sleeve 51 close to the first hole 511 is smaller than that of an inner wall of another end of the second sleeve 51 close to the second hole 512.

The first abutting blocks 53 are movably disposed in the second sleeve 51, the first abutting blocks 53 are arranged in a ring-shaped and spaced from each other, first ends of the first abutting blocks 53 are disposed close to the first hole 511, and the rope 3000 is suitable for being passed through the first hole 511 and disposed between the first abutting blocks 53.

An end of the first locking member 52 is connected to the moving rod 31, another end of the first locking member 52 passes through the second hole 512 and abuts against second ends of the first abutting blocks 53 away from the first hole 511. The first abutting blocks 53 move towards the first hole 511 along the inner wall of the tapered structure in the second sleeve 51 synchronously when the first locking member 52 moves inwardly inside the second sleeve 51, and thereby a distance between the first abutting blocks 53 is correspondingly reduced.

The second sleeve 51 can be made of metal or plastic. An end of the first locking member 52 can be connected to the moving rod 31 with a thread structure. Another end of the first locking member 52 can be connected to the inner wall of the second sleeve 51 through another thread structure. When an end of the rope 3000 passes through the first hole 511 and is disposed between the first abutting blocks 53, the first locking member 52 is rotated to move inwardly inside the second sleeve 51, so as to make the first locking member 52 push the first abutting blocks 53 moving towards the first hole 511 along the inner wall of the tapered structure in the second sleeve 51 synchronously. The distance between the first abutting blocks 53 is correspondingly reduced so that the rope 3000 is clamped tightly and connected to the first clamping member 50. When the rope 3000 is separated from the first clamping member 50, the first locking member 52 is rotated to move out of the second sleeve 51, so as to reduce thrust from the first locking member 52 to the first abutting blocks 53 until the thrust disappears, and clamping forces between the first abutting blocks 53 and the rope 3000 disappear gradually, thereby the rope 3000 is separated from the first clamping member 50, so as to realize fast connection and separation between the rope 3000 and the first clamping member 50, and make its use be more convenient.

In an embodiment of the disclosure, the first locking member 52 includes a locking block 521, a second elastic member 522 and a first sliding block 523.

An end of the locking block 521 is connected to the movable rod 30, another end of the locking block 521 passes through the second hole 512 and connects to the inner wall of the second sleeve 51 by a thread structure.

The second elastic member 522 and the first sliding block 523 are both placed inside the second sleeve 51, an end of the second elastic member 522 abuts against the locking block 521, and another end of the second elastic member 522 abuts against the first sliding block 523.

An end of the first sliding block 523 away from the second elastic member 522 abuts against the first abutting block 53.

The second elastic part 522 can be a spring. The locking block 521 can be connected or fixed to the movable rod 30 through a thread structure. A side face of the locking block 521 connecting to an end of the movable rod 30 can be of a hexagon structure or a similar structure, so as to clamp on the locking block 521 and rotate it by an external wrench to realize rotation adjustment of the locking block 521, and make its use be more convenient.

In an embodiment of the disclosure, the first clamping member 50 further includes a second locking member 54. The second locking member 54 is sleeved on the movable rod 30. The second locking member 54 is located at the end of the first locking member 52 away from the second sleeve 51.

The second locking member 54 can be a nut. The second locking member 54 is rotated to closely abut against a corresponding position of the first locking member 52, so as to avoid looseness of the first locking member 52, and make connection between the first clamping member 50 and the rope 3000 be more stable.

Referring to FIG. 1 and FIG. 2, the disclosure further provides a rope assembly 2000 which includes a rope 3000, a rope connector 1000 or two rope connectors. An end of the rope 3000 is connected to the rope connector 1000 or two ends of the rope 3000 are respectively connected to the two rope connectors 1000. The rope connector(s) 1000 is/are the aforementioned rope connector 1000. The rope 3000 can be a steel wire rope. The rope assembly 2000 is more convenient for use. After the rope 3000 is tensioned, a force in axial direction which the rope 3000 is subjected to is an elastic force, which is smaller than a rigid locking force, so that an axial load which the rope 3000 is subjected to is smaller relatively, so as to increase service life of the rope 3000. Since the aforementioned rope connector 1000 is applied in the rope assembly 2000, the rope assembly 2000 also is of all the beneficial effects brought by the rope connector 1000 in the embodiments above, and there no more details here.

Figure 4:
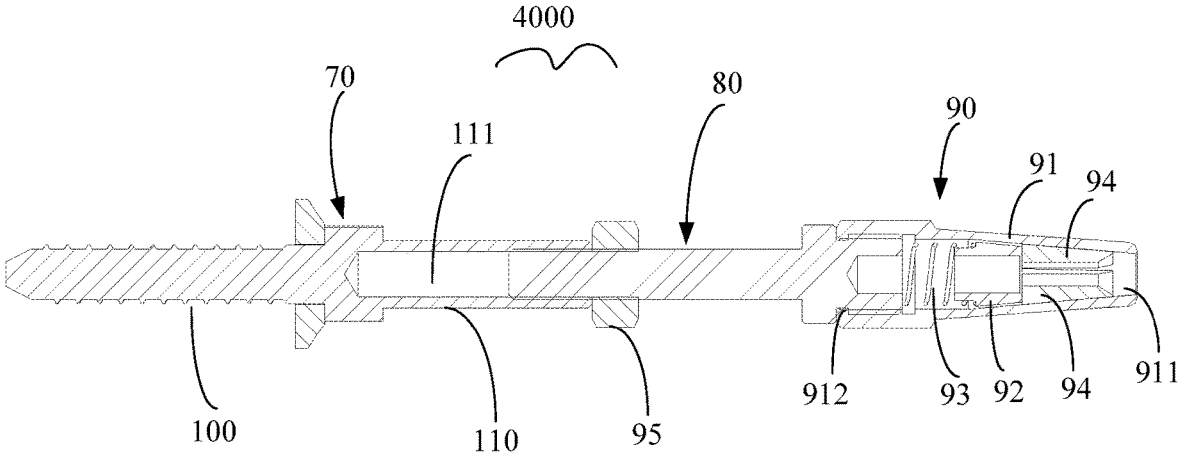
FIG. 4 is a schematic cross-sectional structural view of an embodiment of a rope assembly shown in FIG. 1.

Referring to FIG. 1, FIG. 2 and FIG. 4, the disclosure further provides a rope assembly 2000 which includes a rope 3000, a rope connector 1000 and a rope connection component 4000. Two ends of the rope 3000 are respectively connected to the rope connector 1000 and the rope connection component 4000. The rope connector 1000 is the rope connector 1000 mentioned above. The rope connection component 4000 includes a second connecting part 70, an adjusting rod 80 and a second clamping member 90.

An end of the second connecting part 70 is disposed with a third connecting portion 100, another end of the second connecting part 70 is provided with a fourth connecting portion 110, an end of the fourth connecting portion 110 is formed with a holding groove 111.

An end of the adjusting rod 80 is disposed inside the holding groove 111, the adjusting rod 80 is screw-connected to an inner wall of the holding groove 111.

The second clamping member 90 is disposed on another end of the adjusting rod 80 away from the second connecting part 70.

In conjunction with the rope connector 1000, the adjusting rod 80 is configured to adjust tension of the rope 3000. The rope connector 1000 and the rope connection component 4000 are installed and fixed firstly, then two ends of the rope 3000 are respectively connected to the rope connector 1000 and the rope connection component 4000, and finally the tension of the rope 3000 is adjusted through the adjusting rod 80, so that the rope assembly 2000 can be assembled and installed more convenient and fast, which make its use be more convenient. Due to the installation method of hard tension of bolts to the two ends of a rope assembly in prior art, during installation process of the rope assemblies, 9 rows of rope assemblies are generally installed, the middle row of rope assembly is installed firstly, and then 8 rows of rope assemblies which are upper and lower than the middle row of rope assembly are installed in sequence. During the installation process, bolts at two ends of each row of rope assembly are pre-locked firstly, and then their tightness of each bolt is adjusted as a whole, so as to make tension states of 9 rows of rope assemblies be consistent. The rope assemblies often need to be adjusted many times, which is very troublesome. However, for the rope assembly of the disclosure, only the rope connection component 4000 of each row of rope assembly needs to be adjusted so as to achieve the same tension state of the rope 3000, without the adjustment of both ends of the rope assembly, which can greatly improve installation efficiency of the rope assembly 2000. In addition, after the rope 3000 is tensioned, a force in axial direction is an elastic force, which is smaller than a rigid locking force, so that a radial load which the rope 3000 bears is smaller relatively, so as to extend service life of the rope 3000. Since the aforementioned rope connector 1000 is applied, the rope assembly 2000 also has all the beneficial effects brought by the embodiment of the rope connector 1000, and there no more details here.

Further, in an embodiment of the disclosure, the second clamping member 90 includes a third sleeve 91, a second sliding block 92, a third elastic member 93, and at least two second abutting blocks 94.

Two ends of the third sleeve 91 are respectively provided with a third hole 911 and a fourth hole 912 communicating with an interior of the third sleeve 91. An inner wall of the third sleeve 91 close to the third hole 911 is of a tapered structure. A transversal cross-section area of the inner wall of the end of the third sleeve 91 close to the third hole 911 is smaller than that of an inner wall of another end of the third sleeve 91 close to the fourth hole 912.

The second abutting blocks 94 are movably placed inside the third sleeve 91, the second abutting blocks 94 are arranged in a ring-shaped and spaced from each other, first ends of the second abutting blocks 94 are disposed close to the third hole 911, and the rope 3000 passes through the third hole 911 and is disposed between the second abutting blocks 94.

The another end of the adjusting rod 80 away from the second connecting part 70 is disposed inside the third sleeve 91 after passing through the fourth hole 912, and the adjusting rod 80 is connected to an inner wall of the third sleeve 91 through a thread structure.

The third elastic member 93 and the second sliding block 92 both are placed inside the third sleeve 91, an end of the third elastic member 93 abuts against the adjusting rod 80, another end of the third elastic member 93 abuts against the second sliding block 92, and an end of the second sliding block 92 away from the third elastic member 93 abuts against the second abutting blocks 94.

The second abutting blocks 94 move towards the third hole 911 along the inner wall of the tapered structure in the third sleeve 91 synchronously when the adjusting rod 80 gradually moves inwardly inside the third sleeve 91, and thereby a distance between the second abutting blocks 94 is correspondingly reduced.

The third sleeve 91 can be made of metal or plastic. When an end of the rope 3000 passes through the third hole 911 and is disposed between the second abutting blocks 94, the adjusting rod 80 is rotated to move inwardly inside the third sleeve 91, so as to make the adjusting rod 80 push the second abutting blocks 94 moving towards the third hole 911 along the inner wall of the tapered structure in the third sleeve 91 synchronously. The distance between the second abutting blocks 94 is correspondingly reduced so that the rope 3000 is clamped and connected to the second clamping member 90. When the rope 3000 is separated from the second clamping member 90, the adjusting rod 80 is rotated to move out of the third sleeve 91, so as to reduce thrust from the adjusting rod 80 against the second abutting blocks 94 until the thrust disappears. The clamping forces between the second abutting blocks 94 and the rope 3000 also disappear gradually. The rope 3000 can be separated from the second clamping member 90, so as to realize that fast connection and separation between the rope 3000 and the second clamping member 90, and make its use be more convenient.

In an embodiment of the disclosure, the rope connection component 4000 further includes a third locking member 95. The third locking member 95 is sleeved on the adjusting rod 80 through a thread structure, and the third locking member 95 abuts against an end of another connecting part 70.

The third locking member 95 can be a nut. The third locking member 95 closely abuts against a corresponding position of the second connecting part 70, which avoids looseness between the adjusting rod 80 and the fourth connecting portion 110 and makes connection between the second clamping member 90 and the rope 3000 be more stable.

Figure 3:
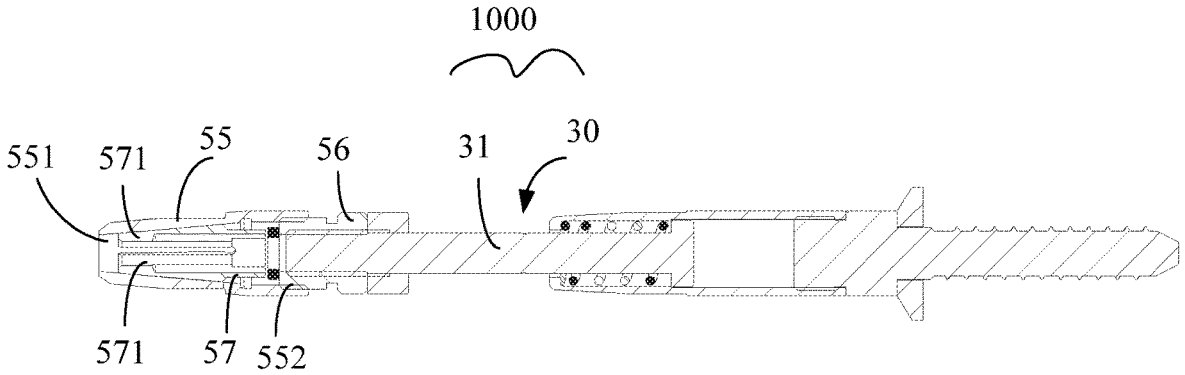
FIG. 3 is a schematic cross-sectional structural view of another embodiment of the rope connector shown in FIG. 1.
Figure 5:
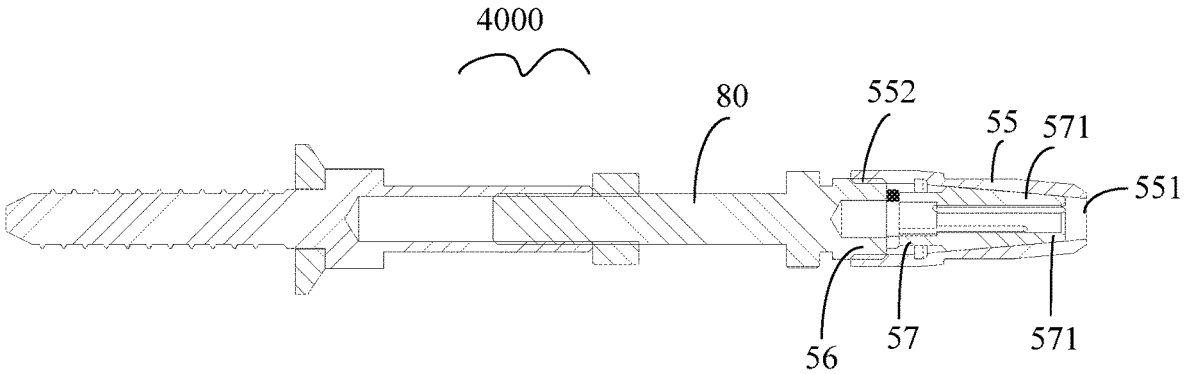
FIG. 5 is a schematic cross-sectional structural view of another embodiment of the rope assembly shown in FIG. 1.

Referring to FIG. 1, FIG. 3 and FIG. 5, in an embodiment of the disclosure, the first clamping member 50 and the second clamping member 90 each include a fourth sleeve 55, a fourth locking member 56 and a clamping jaw 57.

Two ends of the fourth sleeve 55 are respectively provided with a fifth hole 551 and a sixth hole 552 communicating with an interior of the fourth sleeve 55. An inner wall of the fourth sleeve 55 close to the fifth hole 551 is a tapered structure. A transversal cross-section area of the inner wall of the end of the fourth sleeve 55 close to the fifth hole 551 is smaller than that of an inner wall of another end of the fourth sleeve 55 close to the sixth hole 552.

The clamping claw 57 is movably disposed in the fourth sleeve 55, an end of the clamping claw 57 close to the fifth hole 551 is provided with a plurality of holding pieces 571, the holding pieces 571 are arranged in a ring-shaped and spaced from each other, and the rope 3000 passes through the fifth hole 551 and is placed between the holding pieces 571.

An end of the fourth locking member 56 of the first clamping member 50 is connected to the movable rod 30, and another end of the fourth locking member 56 of the first clamping member 50 abuts against an end of the clamping claw 57 away from the holding pieces 571 after passing through the corresponding sixth hole 552.

An end of the fourth locking member 56 of the second clamping member 90 is connected to the adjusting rod 80, and another end of the fourth locking member 56 of the second clamping member 90 abuts against an end of the clamping claw 57 away from the holding pieces 571 by passing through the corresponding sixth hole 552.

The fourth sleeve 55 and the fourth locking member 56 can be made of metal, and the clamping claw 57 can be made of metal or plastic. An end of the fourth locking member 56 of the first clamping member 50 is connected to the movable rod 30 through a thread structure, and another end of the fourth locking member 56 passes through the sixth hole 552 and abuts against an end of the clamping claw 57 away from the holding pieces 571. When an end of the rope 3000 passes through the fifth hole 551 and is disposed between the holding pieces 571 of the clamping claw 57, the fourth locking member 56 is rotated to move inwardly inside the fourth sleeve 55, so as to make an end of the fourth locking member 56 disposed in the fourth sleeve 55 push an end of the clamping claw 57 away from the holding pieces 571. When the fourth locking member 56 moves inwardly inside the fourth sleeve 55, the holding pieces 571 move towards the fifth hole 551 along the inner wall of the tapered structure in the fourth sleeve 55 synchronously, the distance between the holding pieces 571 is correspondingly reduced, so as to realize tight connection of the corresponding end of the rope 3000. When the rope 3000 is separated from the first clamping member 50, the fourth locking member 56 is rotated to move out of the fourth sleeve 55, so as to reduce thrust from the fourth locking member 56 to the clamping claw 57 until the thrust disappears. The clamping forces between the holding pieces 571 of the clamping claw 57 and the rope 3000 also disappear gradually, thereby the rope 3000 is separated from the first clamping member 50, so as to realize fast connection and separation of the rope 3000 and the first clamping member 50, and make its use be more convenient.

An end of the fourth locking member 56 of the second clamping member 90 can be fixedly connected with the adjusting rod 80 or integrally formed with the adjusting rod 80. The connection and release methods of the second clamping member 90 and the rope 3000 are the same as that of the first clamping member 50 and the rope 3000, and there are no more details here. Fast connection and separation between the rope 3000 and the second clamping member 90 are realized through the second clamping member 90, which makes its use be more convenient.

Referring to FIG. 1, the disclosure further provides a railing which includes a frame 5000 and a rope assembly 2000. The rope assembly 2000 is disposed inside the frame 5000, and the rope assembly 2000 is the rope assembly 2000 mentioned in the above embodiments. The frame 5000 can be a metal frame or a wooden frame, the frame 5000 can be a rectangular outer frame. The two ends of the rope assembly 2000 can be fixed on the opposite sides of the frame 5000 respectively. A plurality of rope assembly 2000 can be disposed in sequence and spaced from each other, so as to realize fast assembly of the railing and make its use be more convenient. Since the rope assembly 2000 mentioned above is applied in the railing of the disclosure, and the rope connector 1000 mentioned above is applied in the rope assembly 2000, the railing also has all the beneficial effects of the rope connector 1000, and there are no more details here.

The above embodiments are only the preferred embodiments of the disclosure, which does not limit scope of patent of the disclosure. Under the invention concept of the disclosure, any equivalent structural transformation made by using the description and the attached drawings of the disclosure, or direct/indirect application in other related technology fields are included in the scope of patent protection of the disclosure.

What is claimed is:

1. A rope connector comprising:

a first connecting part, a first sleeve, a movable rod, a first elastic member, a first clamping member, and a ring-shaped cushion block;

wherein an end of the first sleeve is disposed at an end of the first connecting part, another end of the first sleeve is disposed with a first opening communicating with an interior of the first sleeve;

wherein a first end of the movable rod passes through the first opening and is movably disposed inside the first sleeve, and a second end of the movable rod is connected to the first clamping member;

wherein the first elastic member is disposed inside the first sleeve, an end of the first elastic member abuts against an edge of the first opening, and another end of the first elastic member is connected to the first end of the movable rod;

wherein an end of the first clamping member away from the movable rod is configured for being detachably connected to a rope;

wherein the ring-shaped cushion block is sleeved on a first connecting portion of the first connecting part;

wherein the first sleeve is detachably connected to the first connecting part;

wherein the first connecting part comprises a locking portion and a second connecting portion; the first connecting portion and the second connecting portion are respectively located at two opposite ends of the locking portion, and the second connecting portion is connected to the end of the first sleeve away from the first opening;

wherein the end of the first sleeve away from the first opening is disposed with a second opening communicating with the interior of the first sleeve, the second connecting portion passes through the second opening and is disposed inside the first sleeve, and the second connecting portion is detachably connected to an inner wall of the first sleeve;

wherein the movable rod comprises a moving rod and an abutting portion provided at an end of the moving rod, the abutting portion is disposed inside the first sleeve, the first elastic member is sleeved on the moving rod, and the another end of the first elastic member away from the first opening abuts against the abutting portion;

wherein a convex portion is disposed on the inner wall of the first sleeve, an end of the abutting portion away from the moving rod abuts against the second connecting portion of the first connecting part when the movable rod is in a first position, and another end of the abutting portion close to the moving rod abuts against the convex portion when the movable rod is in a second position.

2. The rope connector as claimed in claim 1, wherein the first clamping member comprises a second sleeve, a first locking member, and at least two first abutting blocks;

two ends of the second sleeve are respectively provided with a first hole and a second hole both communicating with an interior of the second sleeve, an inner wall of the second sleeve close to the first hole is of a tapered structure, a transversal cross-section area of the inner wall of the end of the second sleeve close to the first hole is smaller than that of an inner wall of another end of the second sleeve close to the second hole;

the first abutting blocks are movably disposed inside the second sleeve, the first abutting blocks are arranged in a ring-shaped and spaced from each other, first ends of the first abutting blocks are disposed close to the first hole, and the rope is configured for being passed through the first hole and disposed between the first abutting blocks;

an end of the first locking member is connected to the moving rod, and another end of the first locking member passes through the second hole and abuts against second ends of the first abutting blocks away from the first hole; the first abutting blocks move towards the first hole along the inner wall of the tapered structure in the second sleeve synchronously when the first locking member gradually moves inwardly inside the second sleeve, and thereby a distance between the first abutting blocks is correspondingly reduced.

3. The rope connector as claimed in claim 2, wherein the first locking member comprises a locking block, a second elastic member and a first sliding block;

an end of the locking block is connected to the movable rod, another end of the locking block passes through the second hole and connects to the inner wall of the second sleeve by a thread structure;

the second elastic member and the first sliding block are both placed inside the second sleeve, an end of the second elastic member abuts against the locking block, and another end of the second elastic member abuts against the first sliding block;

an end of the first sliding block away from the second elastic abuts against the first abutting blocks.

4. The rope connector as claimed in claim 3, wherein the locking block is connected to the movable rod through a thread structure.

5. The rope connector as claimed in claim 4, wherein the first clamping member further comprises a second locking member, the second locking member is sleeved on the movable rod, and the second locking member is located at the end of the first locking member away from the second sleeve.

6. A rope assembly comprising a rope, a rope connector and a rope connection component; wherein two ends of the rope are respectively connected to the rope connector and the rope connection component, the rope connector is as claimed in claim 1, the rope connection component comprises a second connecting part, an adjusting rod, and a second clamping member;

an end of the second connecting part is disposed with a third connecting portion, another end of the second connecting part is disposed with a fourth connecting portion, and an end of the fourth connecting portion is formed with a holding groove;

an end of the adjusting rod is disposed inside the holding groove, and the adjusting rod is screw-connected to an inner wall of the holding groove;

the second clamping member is disposed on another end of the adjusting rod away from the second connecting part.

7. The rope assembly as claimed in claim 6, wherein the second clamping member comprises a third sleeve, a second sliding block, a third elastic member, and at least two second abutting blocks;

two ends of the third sleeve are respectively provided with a third hole and a fourth hole communicating with an interior of the third sleeve, an inner wall of the third sleeve close to the third hole is of a tapered structure, and a transversal cross-section area of the inner wall of the end of the third sleeve close to the third hole is smaller than that of an inner wall of another end of the third sleeve close to the fourth hole;

the second abutting blocks are movably disposed inside the third sleeve, the second abutting blocks are arranged in a ring-shaped and spaced from each other, first ends of the second abutting blocks are disposed close to the third hole, and the rope is configured for being passed through the third hole and disposed between the second abutting blocks;

the another end of the adjusting rod away from the second connecting part is disposed inside the third sleeve after passing through the fourth hole, and the adjusting rod is connected to an inner wall of the third sleeve through a thread structure;

the third elastic member and the second sliding block both are placed inside the third sleeve, an end of the third elastic member abuts against the adjusting rod, another end of the third elastic member abuts against the second sliding block, and an end of the second sliding block away from the third elastic member abuts against the second abutting blocks;

the second abutting blocks move towards the third hole along the inner wall of the tapered structure in the third sleeve synchronously when the adjusting rod gradually moves inwardly inside the third sleeve, and thereby a distance between the second abutting blocks is correspondingly reduced.

8. The rope assembly as claimed in claim 7, wherein the rope connection component further comprises a third locking member, the third locking member is sleeved on the adjusting rod by a thread structure, and the third locking member abuts against the another end of the second connecting part.

9. The rope assembly as claimed in claim 6, wherein the first clamping member and the second clamping member each comprise a fourth sleeve, a fourth locking member and a clamping jaw;

two ends of the fourth sleeve are respectively provided with a fifth hole and a sixth hole both communicating with an interior of the fourth sleeve, an inner wall of the fourth sleeve close to the fifth hole is of a tapered structure, and a transversal cross-section area of an inner wall of an end of the fourth sleeve close to the fifth hole is smaller than that of an inner wall of another end of the fourth sleeve close to the sixth hole;

the clamping jaw is movably disposed inside the fourth sleeve, an end of the clamping jaw close to the fifth hole is provided with a plurality of holding pieces, the holding pieces are arranged in a ring-shaped and spaced from each other, and the rope is configured for being passed through the fifth hole and disposed between the holding pieces;

an end of the fourth locking member of the first clamping member is connected to the movable rod, and another end of the fourth locking member of the first clamping member abuts against an end of the clamping jaw [[claw]] far away from the holding pieces after passing through the sixth hole corresponding;

an end of the fourth locking member of the second clamping member is connected to the adjusting rod, and another end of the fourth locking member abuts against an end of the clamping jaw away from the holding pieces after passing through the sixth hole corresponding.

10. A railing comprising a frame and a rope assembly, the rope assembly is disposed inside the frame, and the rope assembly is as claimed in claim 9.

11. The rope assembly as claimed in claim 6, wherein the first clamping member and the second clamping member each comprise a fourth sleeve, a fourth locking member and a clamping jaw;

two ends of the fourth sleeve are respectively provided with a fifth hole and a sixth hole communicating with an interior of the fourth sleeve, an inner wall of the fourth sleeve close to the fifth hole is of a tapered structure, and a transversal cross-section area of an inner wall of an end of the fourth sleeve close to the fifth hole is smaller than that of an inner wall of another end of the fourth sleeve close to the sixth hole;

the clamping jaw is movably disposed inside the fourth sleeve, an end of the clamping jaw close to the fifth hole is provided with a plurality of holding pieces, the holding pieces are arranged in a ring-shaped and spaced from each other, and the rope is configured for being passed through the fifth hole and disposed between the holding pieces;

an end of the fourth locking member of the first clamping member is connected to the movable rod, and another end of the fourth locking member of the first clamping member abuts against an end of the clamping jaw far away from the holding pieces after passing through the sixth hole corresponding;

an end of the fourth locking member of the second clamping member is connected to the adjusting rod, and another end of the fourth locking member abuts against an end of the clamping jaw away from the holding pieces after passing through the sixth hole corresponding.

12. The rope assembly as claimed in claim 6, wherein the first clamping member and the second clamping member each comprise a fourth sleeve, a fourth locking member and a clamping jaw;

two ends of the fourth sleeve are respectively provided with a fifth hole and a sixth hole communicating with an interior of the fourth sleeve, an inner wall of the fourth sleeve close to the fifth hole is of a tapered structure, and a transversal cross-section area of an inner wall of an end of the fourth sleeve close to the fifth hole is smaller than that of an inner wall of another end of the fourth sleeve close to the sixth hole;

the clamping jaw is movably disposed inside the fourth sleeve, an end of the clamping jaw close to the fifth hole is provided with a plurality of holding pieces, the holding pieces are arranged in a ring-shaped and spaced from each other, and the rope is configured for being passed through the fifth hole and disposed between the holding pieces;

an end of the fourth locking member of the first clamping member is connected to the movable rod, and another end of the fourth locking member of the first clamping member abuts against an end of the clamping jaw far away from the holding pieces after passing through the sixth hole corresponding;

an end of the fourth locking member of the second clamping member is connected to the adjusting rod, and another end of the fourth locking member abuts against an end of the clamping jaw away from the holding pieces after passing through the sixth hole corresponding.

* * * * *